US010227225B2

(12) United States Patent
Van Der Weij

(10) Patent No.: US 10,227,225 B2
(45) Date of Patent: Mar. 12, 2019

(54) LIQUID DISPENSING DEVICE AND VALVE ASSEMBLY FOR USE THEREWITH

(71) Applicant: APDS ORIGINALS B.V., Almere (NL)

(72) Inventor: Fedde Van Der Weij, Almere (NL)

(73) Assignee: APDS ORIGINALS B.V., Almere (NL)

( * ) Notice: Subject to any disclaimer, the term of this patent is extended or adjusted under 35 U.S.C. 154(b) by 0 days.

(21) Appl. No.: 15/508,439

(22) PCT Filed: Sep. 4, 2014

(86) PCT No.: PCT/EP2014/068846
§ 371 (c)(1),
(2) Date: Mar. 2, 2017

(87) PCT Pub. No.: WO2016/034235
PCT Pub. Date: Mar. 10, 2016

(65) Prior Publication Data

US 2017/0283234 A1 Oct. 5, 2017

(51) Int. Cl.
*B67D 1/00* (2006.01)
*B67D 3/00* (2006.01)
(Continued)

(52) U.S. Cl.
CPC ..... *B67D 1/0001* (2013.01); *B67D 1/0004* (2013.01); *B67D 1/0081* (2013.01);
(Continued)

(58) Field of Classification Search
CPC .. B67D 1/0001; B67D 1/0004; B67D 1/0081; B67D 1/0857; B67D 2001/0827;
(Continued)

(56) References Cited

U.S. PATENT DOCUMENTS 4,595,121 A 6/1986 Schultz
5,524,864 A * 6/1996 Dubach ..... B67D 3/043 251/267
6,056,157 A * 5/2000 Gehl ..... B65D 77/06 222/105
6,708,741 B1 3/2004 Berry
8,091,735 B2 * 1/2012 Girard ..... A47J 31/402 222/105
(Continued)

FOREIGN PATENT DOCUMENTS

AU 2002301203 A1 6/2003
AU 2013204096 A 2/2014
(Continued)

OTHER PUBLICATIONS

International Search Report and Written Opinion for International patent application No. PCT/EP2014/068846, dated Feb. 24, 2015.

*Primary Examiner* — Frederick C Nicolas
(74) *Attorney, Agent, or Firm* — Steven M. Koehler; Westman, Champlin & Koehler, P.A.

(57) ABSTRACT

A liquid dispensing device for use with a flexible bag containing a liquid and having a spigot connected thereto includes a housing, a valve assembly and a member. The housing includes an upper part having a receiver configured to receive the spigot. The valve assembly is housed within the receiver and includes a liquid channel and a valve. The liquid channel has an inner end configured to connect to the spigot, and an outer end opposite the inner end. The valve, which is positioned closer to the outer end than the inner end, includes a closed position, in which a flow of the liquid through the liquid channel is prevented, and an open position for dispensing the liquid through the liquid channel. The member is configured to keep the spigot in a permanent open position when the spigot is connected to the inner end of the liquid channel.

20 Claims, 7 Drawing Sheets

(51) Int. Cl.
*B67D 3/04* (2006.01)
*B67D 1/08* (2006.01)

(52) U.S. Cl.
CPC ..... *B67D 3/009* (2013.01); *B67D 3/04* (2013.01); *B67D 3/047* (2013.01); *B67D 1/0044* (2013.01); *B67D 1/0857* (2013.01); *B67D 3/0029* (2013.01); *B67D 3/042* (2013.01); *B67D 2001/0827* (2013.01)

(58) Field of Classification Search
CPC ..... B67D 3/042; B67D 3/009; B67D 3/047; B67D 1/0044; B67D 3/04; B67D 3/0029
See application file for complete search history.

(56) References Cited

U.S. PATENT DOCUMENTS

| | | | | |
|---|---|---|---|---|
| 2013/0240562 | A1 | 9/2013 | Middleton | |
| 2014/0091107 | A1 | 4/2014 | Becker | |
| 2014/0291350 | A1 | 10/2014 | Middleton | |
| 2017/0297886 | A1* | 10/2017 | Van Der Weij ..... | B67D 1/0045 |

FOREIGN PATENT DOCUMENTS

| | | | |
|---|---|---|---|
| CN | 201372191 | Y | 12/2009 |
| CN | 201958676 | U | 9/2011 |
| CN | 202269919 | U | 6/2012 |
| CN | 202346740 | U | 7/2012 |
| FR | 2601747 | A1 | 1/1988 |
| GB | 2473744 | A | 3/2011 |

* cited by examiner

LIQUID DISPENSING DEVICE AND VALVE ASSEMBLY FOR USE THEREWITH

CROSS-REFERENCE TO RELATED APPLICATION

The present application is a national stage of and claims priority of International patent application Serial No. PCT/EP2014/068846, filed Sep. 4, 2014, and published in English as WO2016/034235 A1, the content of which is hereby incorporated by reference in its entirety.

BACKGROUND

The discussion below is merely provided for general background information and is not intended to be used as an aid in determining the scope of the claimed subject matter.

The invention firstly relates to a liquid dispensing device for use with a flexible bag containing said liquid and having a spigot connected thereto, which device comprises a housing for receiving the bag, which housing in its upper part is provided with a receiver for receiving the spigot.

Liquid dispensing devices of the type referred to above are applied in the field of so-called bag in box packagings for beverages like wine, water and juices, of which the use has grown steadily during the last decades, especially for wine. The reason for this success lies in the advantages for all parties involved in the distribution chain, such as less packaging weight, less packaging cost, large beverage volume per packaging, efficient rectangular shape, easy to carry, long holding time, material and energy saving. Such dispensing devices are capable of pouring one portion at a time from a larger packaging unit (the flexible bag). Larger packaging units means more product (liquid such as beverage) per packaging, hence less packaging weight per unit of product.

The use of the bag in box packaging, however, has a number of drawbacks which contribute to a perception of low user-friendliness. There are different types of valves that come with bag in box packagings, that all require a different way to operate: pushing, lifting, squeezing, rotating, etcetera. The tactile and ergonomic properties of these valves are only suboptimal: the size is big enough for many people, but for most it is not, the fixation of the valve to the carton box is weak and flexible and the required hand position and hand action is not very convenient.

It is noted, that within the context of the present invention the indication "spigot" not only refers to a liquid outlet with some kind of operable valve member, but also may encompass a simple spout without such a valve member.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

The present disclosure provides a liquid dispensing device wherein the receiver houses a valve assembly defining there through a liquid channel, wherein the liquid channel has an inner end adapted for, in a liquid-tight manner, connecting to the spigot of the flexible bag and wherein the liquid channel closer to its opposite outer end is provided with a valve which is movable between a closed position for preventing a flow of the liquid and an open position for dispensing the liquid and wherein further a member is provided for keeping said spigot, once connected to said inner end of the liquid channel, in a permanent open position.

The provision of the valve assembly with liquid channel of which the inner end is adapted for connecting to the spigot of the flexible bag, allows to optimise the design, ergonomics and operational features of the valve irrespective the type of spigot. Thus, only one type of operation is needed for all types of spigots; further, also when the flexible bag comes with a low cost, low quality spigot, the device may be provided with a universal, more advanced valve. When the spigot is of the type having a valve member, the member for keeping the spigot in a permanent open position may, for example, act on said valve member. When the spigot is of the type comprising a simple spout, said member could, for example, comprise a part to be introduced in said spout for keeping it open.

According to one embodiment, the inner end of the liquid channel is defined in a separate adapter part which is connected to the remainder of the valve assembly in a removable manner. As a result the specific type of adapter part may be selected in view of the type of spigot of the flexible bag. At present there are at least four dominant spigot types on the market and by using corresponding adapters the dispensing device may be used with flexible bags provided with those types of spigots. To change from a bag with one type of spigot to a bag with another type of spigot only requires to replace one adapter with another.

In a further embodiment of the device the valve assembly is removably housed in the receiver, wherein the valve assembly and adapter part, for defining a removable connection there between, are provided with manually disconnectable locking members which are only accessible when the valve assembly is not housed in the receiver. This avoids an unintentional disconnection during positioning a flexible bag in the device or during removing it therefrom, while at the same time offering an instant and easy disconnect when the flexible bag has been removed from the device.

It is also conceivable that the valve assembly and adapter part comprise cooperating interfaces allowing a connection in one relative position only. This ensures a proper connection and ease of use.

The assembly of valve assembly and adapter part connected therewith preferably has an identical outer shape for all types of adapter parts, such that the device is very versatile in its use and creates a uniform connection system for use with many different types of spigots.

Then, it further is convenient when the member for keeping the spigot in a permanent open position is part of the separate adapter part. Each type of spigot generally will require its own specific member for keeping it open, and the provision of such a member in the separate adapter part will ensure that by replacing one adapter part by another, also the appropriate member will be provided. It is conceivable that a single adapter is fit to be used with more than one type of spigot.

For ease of use of the dispensing device with more than one type of spigot, it is conceivable that the housing is provided with a storage space for receiving one or more adapter parts. As such, a selection of adapters always is readily available.

Constructively such a storage space may comprise a drawer, for example in a lowermost base part of the housing.

In another embodiment of the device, the valve of the valve assembly is devised for in its open position mixing the liquid with ambient air. Whereas normally the valve is movable between a closed position and an open position in which the liquid is dispensed without mixing it with ambient air, according to this embodiment the valve is movable between a closed position and an open position in which the liquid is dispensed while mixing it with ambient air, the so-called process of aerating.

Aerating is a known and proven method for neutralising some of the less attractive components of a beverage such as wine, like sulphur dioxide and tannins that can cause bad or bitter taste or smell. Aeration also causes the bouquet of wine to come loose and it softens the overall flavor profile. In general the flavor characteristics improve by aeration. Aeration also increases the oxygen saturation and removes gasses like chlorine, sulphur and carbon dioxide from water and other liquids, which in general improves the overall quality of the beverages.

However, because in some instances aeration also could cause a reduction of the more appreciated bouquet of wine or a loss of subtle flavor characteristics, the present invention allows a user to choose whether to use aeration during dispensing or not by selecting the appropriate type of valve (or by selecting a device with the appropriate type of valve).

In yet other embodiments of the device the housing further may be provided with a support member for the flexible bag, which support member firstly is movable between a lowermost position remote from the receiver for supporting a full bag and an uppermost position near to the receiver for supporting a substantially emptied bag and secondly has an inclined upper support surface sloping down to the side of the receiver.

For increasing the ease of use and/or applicability of the device the following options may be provided, alone or in combination: the provision of a cooling mechanism for cooling a bag (for example for improving the taste of a beverage and increasing its life span once the bag has been opened); an indicator may be provided for the position of the support member (and thus providing an indication of the amount of liquid still present in the bag); an outer surface of the housing may be provided with an indicator about the type of bag (and the liquid present in the bag), for example comprising a receptacle for receiving an information carrier, such as a strip provided with any combination of symbols or words.

An aspect of the invention secondly relates to a valve assembly for use in such a liquid dispensing device.

BRIEF DESCRIPTION OF THE DRAWINGS

Hereinafter aspects of the invention will be elucidated while referring to the drawings, in which.

DETAILED DESCRIPTION

Figure 4:
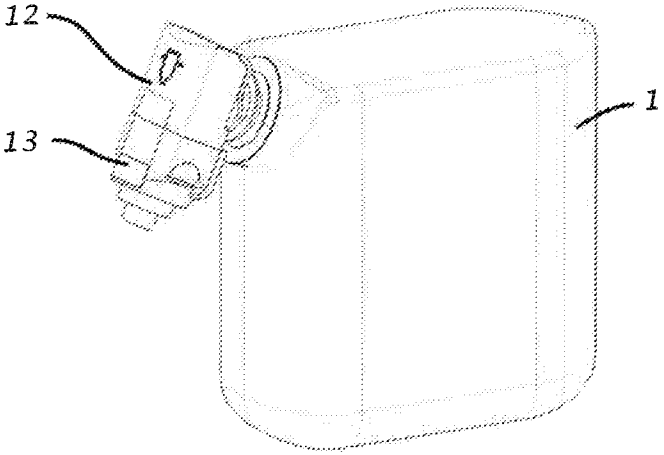
FIG. 4 in a perspective view illustrates a flexible bag attached to a valve assembly.

The liquid dispensing device is intended for use with a flexible bag 1 (best illustrated in FIG. 4) containing said liquid and having a spigot 2 connected thereto. The spigot 2 is of the type comprising a valve member to be operated manually. The device basically comprises a housing 3 for receiving the bag 1. The housing 3 in its upper part is provided with a receiver (housing a valve assembly 4 to be described later) for receiving the spigot 2.

Figure 1:
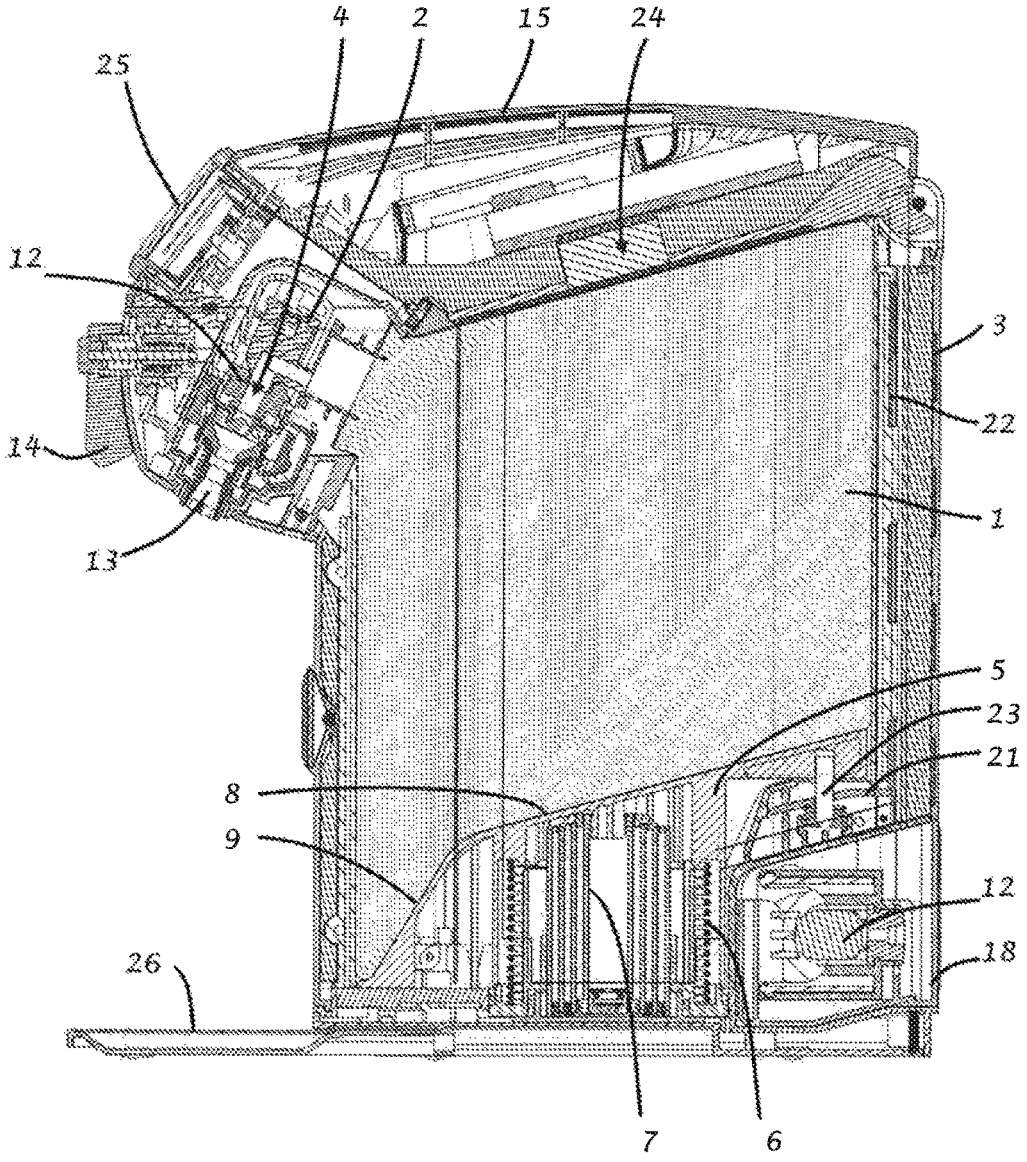
FIG. 1 is a vertical cross-section through an embodiment of the device, housing a full flexible bag containing a liquid.
Figure 2:
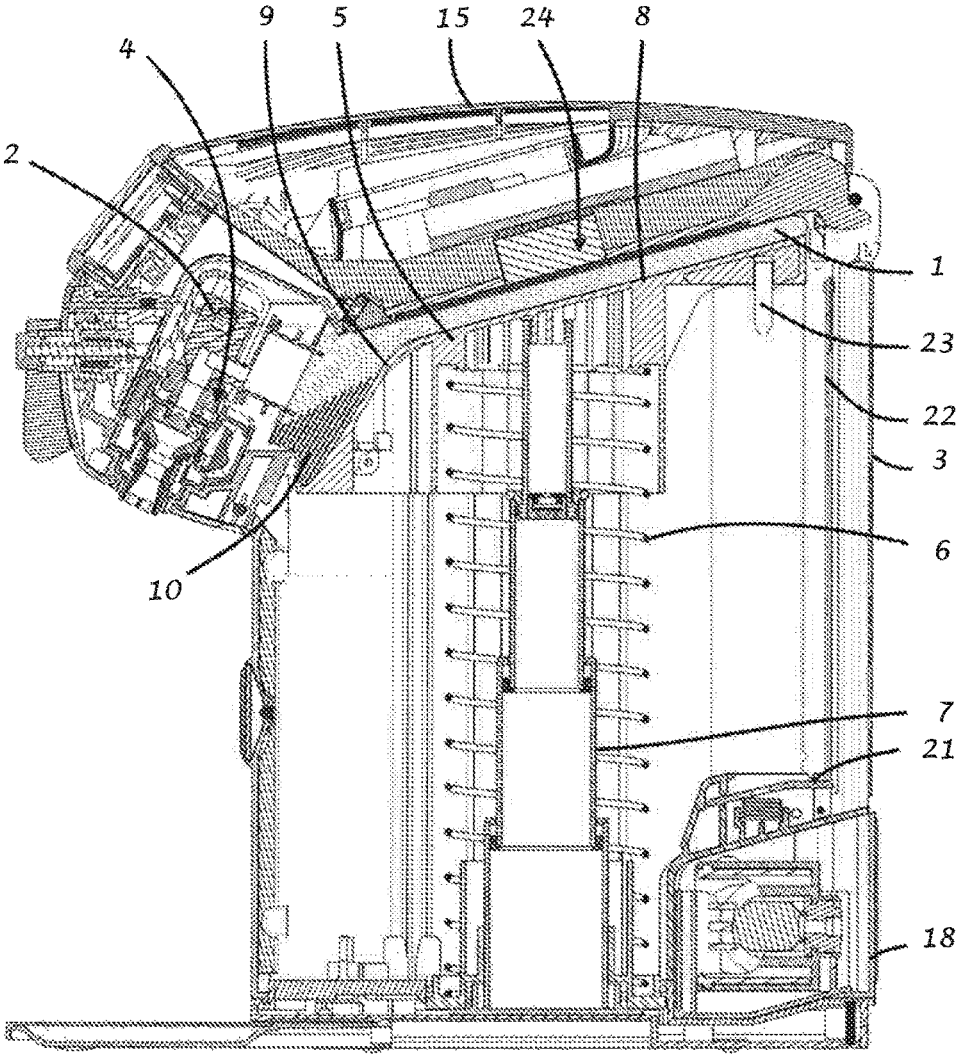
FIG. 2 is a vertical cross-section in accordance with FIG. 1 in which the device houses a nearly empty flexible bag.

The housing further is provided with a support member 5 for the flexible bag 1 which is movable between a lowermost position (as represented in FIG. 1) remote from the valve assembly 4 for supporting a full bag 1, and an uppermost position (as represented in FIG. 2) near to the valve assembly 4 for supporting a substantially emptied bag 1. For achieving its upward movement, the support member 5 is upwardly loaded by a biasing member, such as a compression spring 6, whereas further a damper 7 (for example a pneumatic or hydraulic damper) is provided for slowing down the upward movement of the support member 5 in the event that no bag is present.

The compression spring 6 preferably provides a spring force which decreases in correspondence with a decreasing weight of a bag 1 (as a result of a part of the liquid being dispensed through the valve assembly 4) during the upward movement of the support member 5.

The support member 5 (which may be configured as a plate) has an inclined upper support surface 8 sloping down (with a first slope) to the side of the valve assembly 4, as is clearly visible in FIGS. 1 and 2. This upper support surface 8 comprises, at its side facing the valve assembly 4, a section 9 (best seen in FIG. 1) with a steeper downward slope for, in the uppermost position of the support member 5 (see FIG. 2), defining between said section 9 and the inner end of the valve assembly 4 a receiving space for part of a substantially emptied bag 1 (in FIG. 2 indicated schematically by crinkles 10). As a result the outflow of liquid through the valve assembly 4 will not be blocked by the bag 1 in such a situation.

Figure 3:
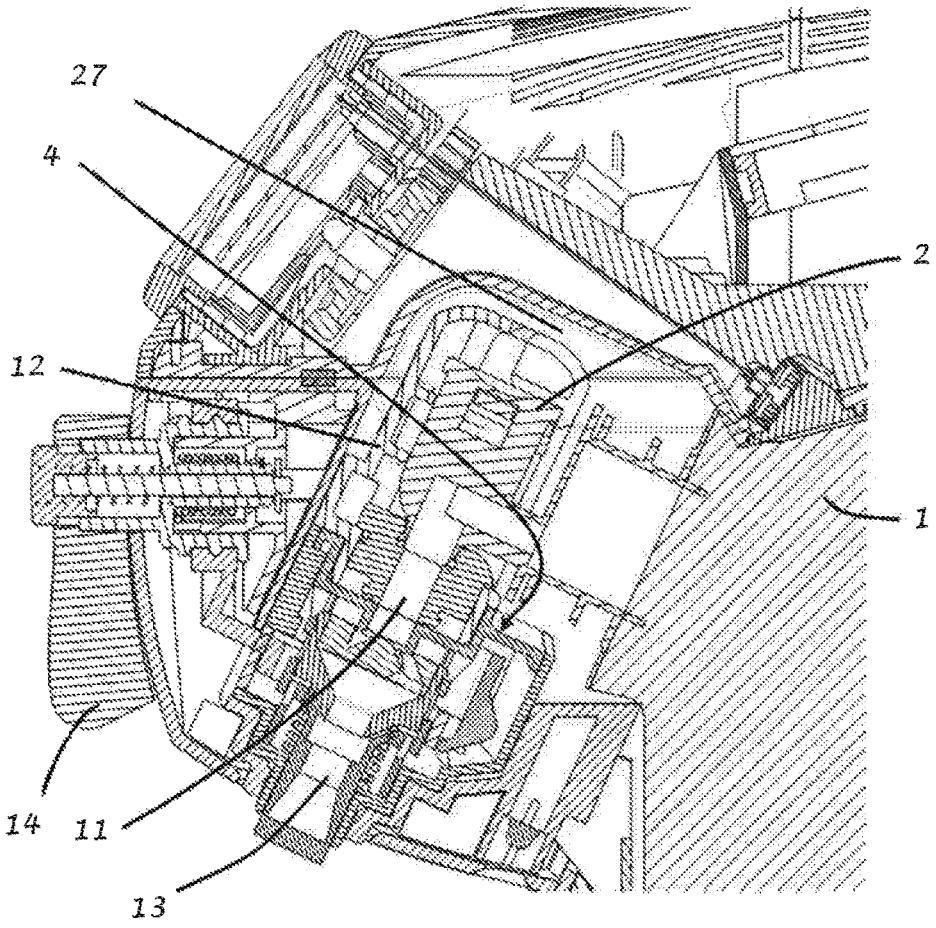
FIG. 3 is a detail of the cross-section of FIG. 1 on a larger scale and showing the valve assembly.

As clearly visible in FIG. 3, the valve assembly 4 defines there through a liquid channel 11 which has an inner end defined in a separate adapter part 12 which is connected to the remainder 13 of the valve assembly 4 in a removable manner. Thus the adapter part 12 may be replaced by another adapter part, if needed. Previous to use, the adapter part 12 firstly with one end is connected to the remainder 13 of the valve assembly and next with the opposite end is connected to the spigot 2 (which then will be opened automatically). Finally, the bag 1 together with the valve assembly thus assembled, is placed into the device (which has a receiving chamber 27 for receiving the valve assembly 4).

Figure 5:
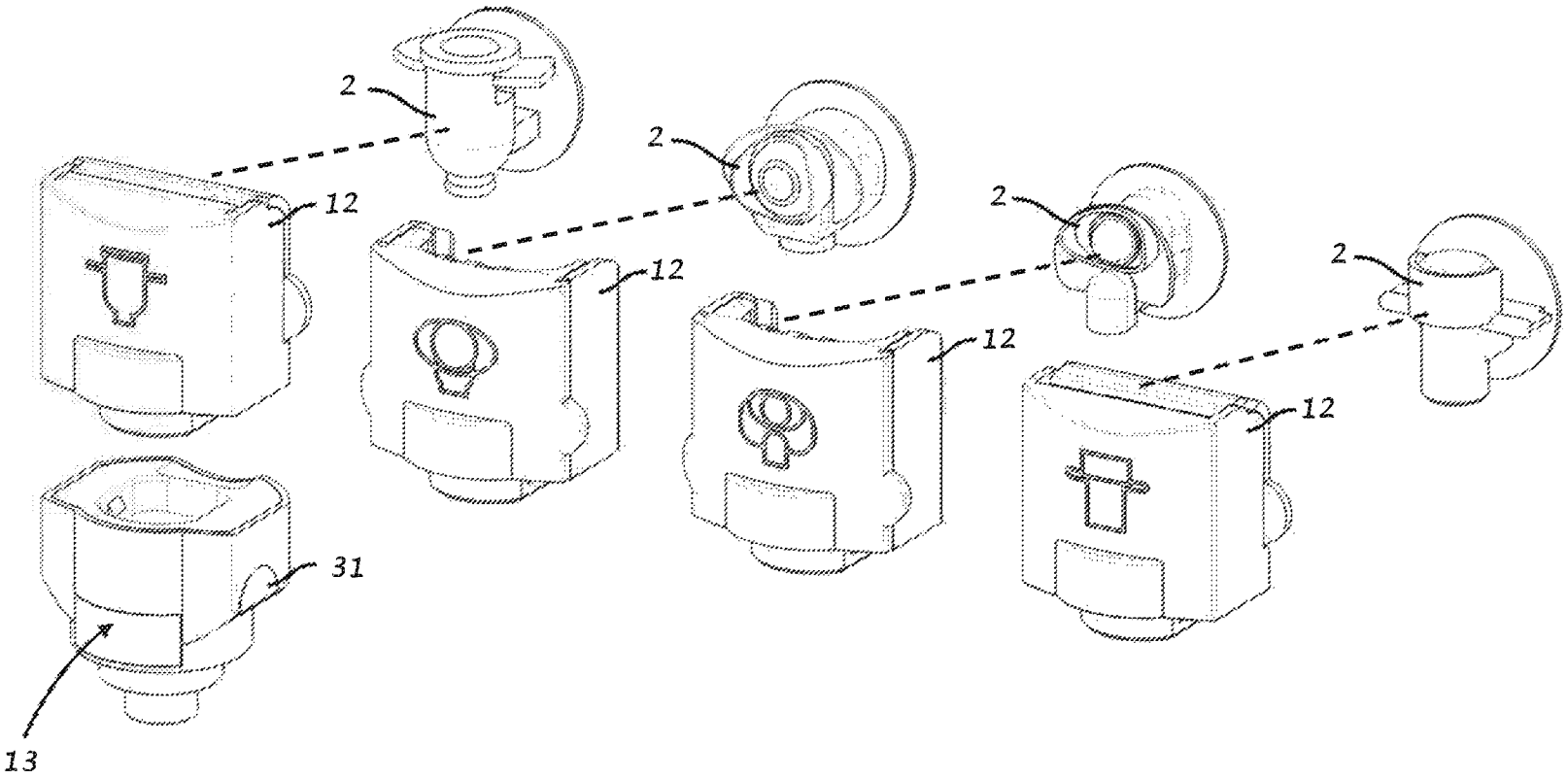
FIG. 5 in a perspective view shows four different adapters with corresponding different types of spigots.

The adapter part 12 is adapted for, in a liquid-tight manner, receiving the spigot 2 of the flexible bag 1. Further, the adapter part 12 is provided with a member for keeping the spigot 2 in a permanent open position when the spigot is received in the adapter part. The position and construction of such a member will depend from the type of spigot 2. FIG. 5 shows as an example a range of four possible types of spigots 2 with corresponding adapter parts 12. Each adapter part 12 therefore at one end has a specific shape for receiving a specific type of spigot 2, but another end (lower end) of all adapter parts 12 is identically shaped for a connection with the remainder 13 of the valve assembly 4. The adapter parts 12 and valve assembly 4 preferably comprise cooperating interfaces allowing a connection in one relative position only.

Figure 6:
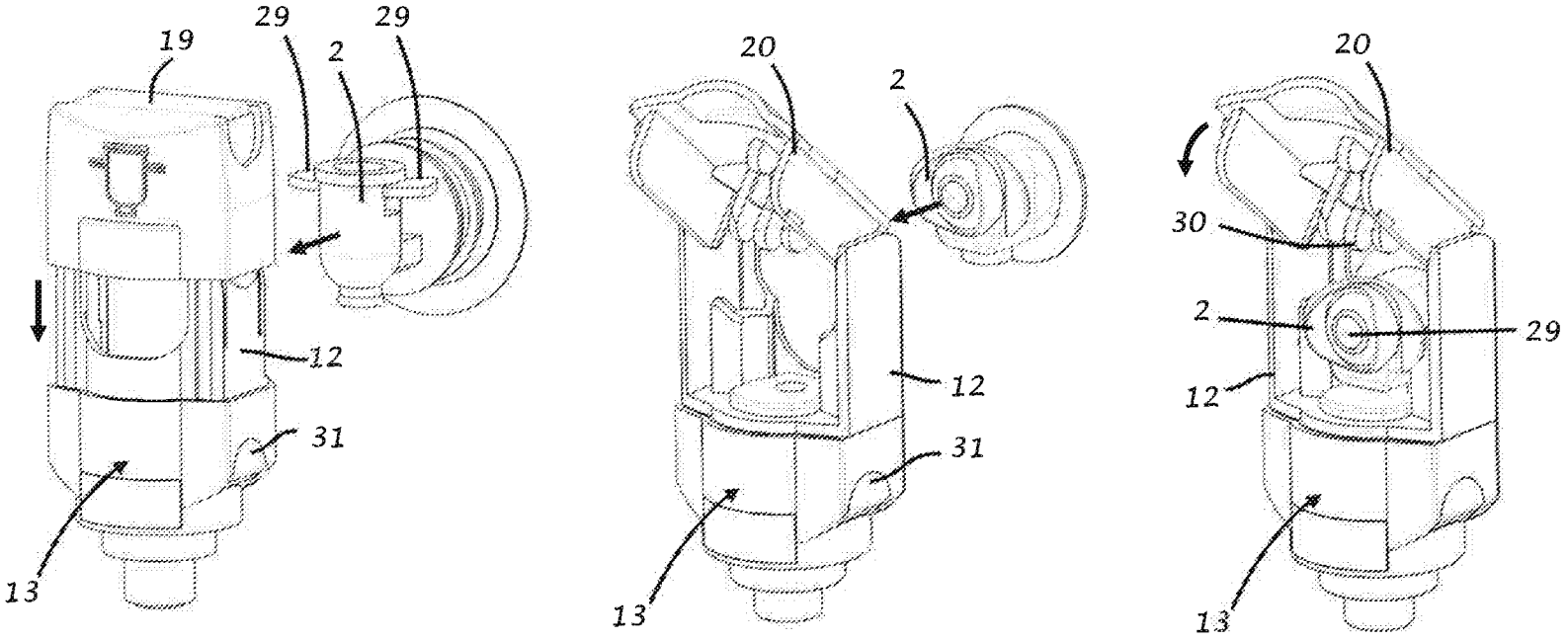
FIG. 6 in a perspective view shows further embodiments of adapters.

FIG. 6 illustrates examples of different manners in which an adapter part 12 may receive a spigot 2. In the left embodiment the adapter part 12 comprises a slidable top part 19 which in an upper position (as illustrated) allows the introduction of the spigot 2 into the adapter part and thereafter is slid down. Inner members (not visible) may be connected to said top part 19 to move along therewith for engaging operating parts 29 of the spigot 2 for keeping it in a permanent open position. The other two views in FIG. 6 relate to an adapter part 12 having a hingeable top part 20 which in an upwardly hinged position (as illustrated) allows the introduction of the spigot 2 into the adapter part and thereafter is hinged down. Here an inner member 30 is illustrated for engaging an operating member 29 of the spigot 2 for keeping it open.

Figure 7:
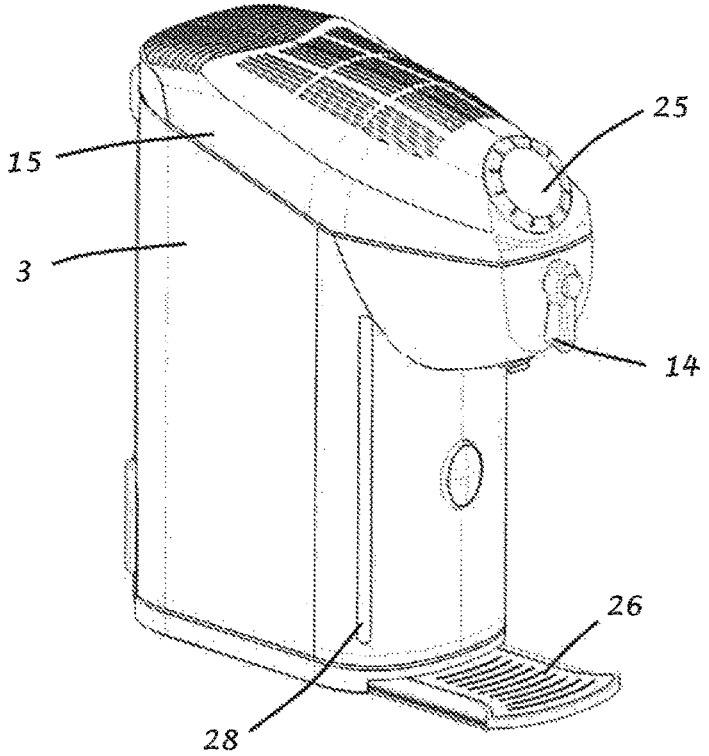
FIG. 7 shows a perspective frontal view of an embodiment of the device.

It is noted that the valve assembly 4 is removably housed in the receiving chamber 27. The valve assembly 4 and adapter part 12, for defining a removable connection there between, are provided with manually disconnectable locking members (in this embodiment illustrated in FIGS. 6 and 7 as disconnect push buttons 31 on the valve assembly 4) which preferably are only accessible when the valve assembly 4 is not housed in the receiving chamber 27.

Figure 8:
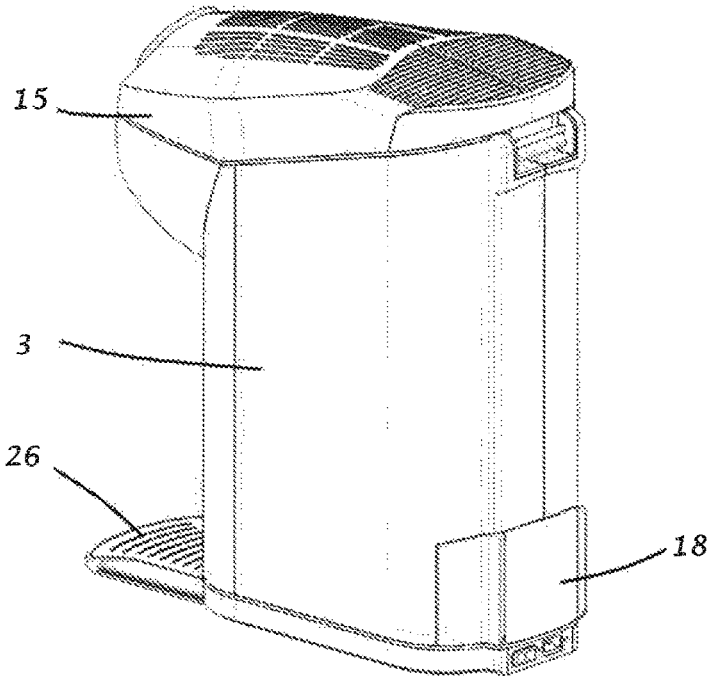
FIG. 8 shows a perspective rear view of the embodiment of the device according to FIG. 7.

The housing 3 may be provided with a storage space for receiving one or more adapter parts 12, such as a drawer 18 (see FIGS. 1, 2 and 8).

The remainder 13 of the valve assembly defines a valve which cooperates with a part of the liquid channel 11 closer to its outer end (compared with the above mentioned inner end that cooperates with a spigot 2) and which is movable between a closed position for preventing a flow of the liquid and an open position for dispensing the liquid. The manner in which such a valve is devised and is operated, may vary in many ways and is not essential for understanding the present invention. With respect to the present invention it is only noted that the valve may be devised for in its open position mixing the liquid in the liquid channel 11 with ambient air, for achieving a so-called aeration of the liquid.

As seen best in FIG. 3, the device may comprise a lever 14 which allows a manual operation of the valve of the valve assembly 4 by a user. Whereas such a lever 14 generally requires a rotating movement, another possible embodiment utilises a push-button. However, also other operation mechanisms for the valve are conceivable. Such mechanisms also may be used to operate, in combination, other parts of the device, such as for example a lid 15 which will be elucidated below.

As shortly indicated before, the housing 3 is provided with a movable lid 15. In an open position the lid 15 offers access to the interior space of the housing 3 for supplying a new full bag 1 or removing an empty one (or for replacing one bag for another containing a different beverage). The housing further is provided with a locking member 21 for engaging the support member 5 (or a pin 23 mounted thereon) in its lowermost position (FIG. 1). Said locking member 21 and lid 15 are operatively connected (for example by a rod 22, see FIG. 2) in such a manner that the locking member 21 is moved to a position for disengaging the support member 5 when the lid 15 moves to a position for closing the housing 3. In the open position of the lid the support member may be pushed down manually until the locking member 21 engages the support member 5 (pin 23) and keeps it in the lowermost position until the lid is closed again.

The device further may be provided with a cooling mechanism 24 for cooling a bag 1. A temperature control unit 25 for controlling the cooling mechanism and for setting the temperature, may be provided too, as well as a temperature indicator.

The device also may be provided with an indicator 28 (see FIG. 7) for the position of the support member 5, and thus for the amount of liquid (beverage) still present in the flexible bag 1. For example such an indicator 28 comprises an elongate transparent window behind which a movable strip (connected to the support member 5) is positioned for showing the position of the support member 5.

An outer surface of the housing 3 may be provided with an indicator about the type of bag 1 present in the device, such as for example a receptacle for receiving an information carrier, such as a strip provided with any combination of symbols or words.

Finally, the device comprises a tray 26 (see FIGS. 7 and 8) onto which a cup may be positioned for receiving the dispended beverage.

The invention is not limited to the embodiments described before which may be varied widely within the scope of the invention as defined by the appending claims.

The invention claimed is:

1. A liquid dispensing device for use with a flexible bag containing a liquid and having a spigot connected thereto, the device comprising:

a housing configured to receive the bag, the housing including an upper part having a receiver configured to receive the spigot;

a valve assembly housed within the receiver, the valve assembly including a liquid channel having a valve, the liquid channel including an inner end configured to connect to the spigot in a liquid-tight manner, and an outer end opposite the inner end, the valve, which is positioned closer to the outer end than the inner end, includes a closed position, in which a flow of the liquid through the liquid channel is prevented, and an open position for dispensing the liquid through the liquid channel; and a member configured to keep said spigot in a permanent open position when the spigot is connected to said inner end of the liquid channel.

2. The device according to claim 1, wherein the inner end of the liquid channel is defined in an adapter part that is connected to the valve assembly in a removable manner.

3. The device according to claim 2, wherein the valve assembly is removably housed in the receiver, and wherein the valve assembly and the adapter part include disconnectable locking members configured to removably connect the valve assembly and the adapter part, wherein the disconnectable locking members are only accessible when the valve assembly is not housed in the receiver.

4. The device according to claim 2, wherein the valve assembly and the adapter part comprise cooperating interfaces allowing a connection in one relative position only.

5. The device according to claim 2, wherein an assembly of the valve assembly and the adapter part connected therewith has an invariable outer shape.

6. The device according to claim 2, wherein the member configured to keep the spigot in a permanent open position is part of the adapter part.

7. The device according to claim 2, wherein the housing is provided with a storage space configured to receive one or more adapter parts.

8. The device according to claim 7, wherein the storage space comprises a drawer.

9. The device according to claim 1, wherein the valve of the valve assembly is configured to mix the liquid with ambient air when in said open position.

10. The device according to claim 1, including a cooling mechanism configured to cool a bag.

11. The device according to claim 1, wherein the housing includes a support member configured to support the flexible bag, wherein the support member is movable between a lowermost position, which is remote from the receiver for supporting a full bag, and an uppermost position, which is near the receiver for supporting a substantially emptied bag, and wherein the support member includes an inclined upper support surface sloping down to a side of the receiver.

12. The device according to claim 1, wherein an outer surface of the housing includes an indicator about a type of bag received therein.

13. The device according to claim 12, wherein the indicator comprises a receptacle configured to receive an information carrier including at least one of symbols or words.

14. The device according to claim 1 and comprising a temperature indicator for the temperature of the bag.

15. A valve assembly for use in a liquid dispensing device for use with a flexible bag containing a liquid and having a spigot connected thereto, the valve assembly comprising:

a liquid channel including an inner end configured to connect to the spigot of the flexible bag in a liquid-tight manner, and an outer end opposite the inner end; and a valve, which is positioned closer to the outer end than the inner end, includes a closed position, in which a flow of the liquid through the liquid channel is prevented, and an open position for dispensing the liquid through the liquid channel; and a member configured to keep said spigot in a permanent open position when the spigot is connected to said inner end of the liquid channel.

16. The valve assembly according to claim 15, wherein the inner end of the liquid channel is defined in a separate adapter part that is connected to the valve assembly in a removable manner.

17. The valve assembly according to claim 16, wherein the valve assembly is removably housed in a receiver of a housing, and wherein the valve assembly and the adapter part include disconnectable locking members configured to removably connect the valve assembly and the adapter part, wherein the disoconnectable locking members are only accessible when the valve assembly is not housed in the receiver.

18. The valve assembly according to claim 16, wherein the valve assembly and the adapter part comprise cooperating interfaces allowing a connection in one relative position only.

19. The valve assembly according to claim 16, wherein an assembly of the valve assembly and the adapter part connected therewith has an invariable outer shape.

20. The valve assembly according to claim 16, wherein the member for keeping the spigot in a permanent open position is part of the adapter part.

* * * * *